US010600275B2

(12) United States Patent
Borissov et al.

(10) Patent No.: US 10,600,275 B2
(45) Date of Patent: Mar. 24, 2020

(54) KEYBOARD FOR PLAYING ONLINE CASINO GAMES

(71) Applicants: Milo Borissov, Dubai Sports (AE); Rossi McKee, Indianapolis, IN (US)

(72) Inventors: Milo Borissov, Dubai Sports (AE); Rossi McKee, Indianapolis, IN (US)

( * ) Notice: Subject to any disclaimer, the term of this patent is extended or adjusted under 35 U.S.C. 154(b) by 303 days.

(21) Appl. No.: 15/268,593

(22) Filed: Sep. 18, 2016

(65) Prior Publication Data

US 2017/0092039 A1 Mar. 30, 2017

Related U.S. Application Data

(60) Provisional application No. 62/233,582, filed on Sep. 28, 2015.

(51) Int. Cl.
*G07F 17/32* (2006.01)

(52) U.S. Cl.
CPC ..... *G07F 17/3209* (2013.01); *G07F 17/3225* (2013.01); *G07F 17/3241* (2013.01)

(58) Field of Classification Search
CPC ..... G07F 17/34
See application file for complete search history.

(56) References Cited

U.S. PATENT DOCUMENTS

2008/0171592 A1* 7/2008 Doan ..... G07F 17/32 463/25
2009/0134972 A1* 5/2009 Wu, Jr. ..... G06F 21/31 340/5.82
2010/0005524 A1* 1/2010 Blythe ..... A63F 13/02 726/20
2016/0110747 A1* 4/2016 Nakai ..... G06Q 30/0207 705/14.12

* cited by examiner

*Primary Examiner* — Robert T Clarke, Jr.
(74) *Attorney, Agent, or Firm* — Weide & Miller, Ltd.

(57) ABSTRACT

A method, system and architecture providing an input device that facilitates access to an online gaming site and/or one or more casino-style games available online, e.g., available via an online gaming site. The input device may be configured to exchange information, e.g., information for use in authorizing the input device for use by a player in playing one or more casino-style games. The input device may be configured to prohibit its use without such authorization. The input device may be configured to work with a particular gaming site, or sites, and/or a particular game, or games, and to not work with any other gaming site(s) and/or game(s).

18 Claims, 8 Drawing Sheets

KEYBOARD FOR PLAYING ONLINE CASINO GAMES

RELATED APPLICATION DATA

This application is a non-provisional of and claims priority to U.S. Provisional Application Ser. No. 62/233,582, filed Sep. 28, 2015.

FIELD OF THE INVENTION

The present invention relates to a keyboard for playing casino-style video games, including online casino-style video games.

BACKGROUND OF THE INVENTION

To play a casino-style video game, such as an online casino-style video game, a player typically provides input to direct play of the game. A general purpose computing device that a player might use to access an online casino-style video game typically has general purpose input devices such as a keyboard and mouse. A problem with a general purpose input device is that it is not customized for use with a casino-style video game. A general purpose keyboard, for example, has a limited set of keys intended for general purpose use/input, e.g., an alphanumeric character set, navigational/cursor key set, function key set, etc. A general purpose input device does not have a specialized set of buttons, for example, for use with an online casino-style video game. Consequently and when using a general purpose input device with an online casino-style video game, a player must be able to adapt to using a general purpose input device in order to correctly provide input for playing the game.

Furthermore, most online casino-style gaming sites and/or online casino-style games require some form of authentication or information before permitting a user to play a game. A conventional input device is only able to forward signals representing the keys and/or buttons pressed by the user. For example, one conventional authentication approach requires the user to enter authentication information using an input device, e.g., a keyboard, such as a username and/or password. Such input is useful to authenticate the player. Other types or levels of authentication would be beneficial.

An input device for use by a player for accessing a casino-style video game provided by an online site or provider is desired.

SUMMARY OF THE INVENTION

Embodiments of the invention comprise an input device for use with an online casino-style game and a site providing such a game and methods and systems for use of such a device.

In accordance with at least one embodiment, an input device facilitates access to an online gaming site and/or one or more casino-style games available online, e.g., available via an online gaming website. In accordance with such an embodiment, the input device is configured to exchange information, e.g., information for use in authorizing the input device for use by a player in playing one or more casino-style games and/or accessing one or more online gaming website(s). Additionally and in accordance with such an embodiment, the input device may be configured to prohibit its use without such authorization. In other words, the input device may be configured to work with a particular online casino-style gaming site, or sites, and/or a particular online casino-style game, or games, and to not work with any other site(s) and/or game(s). By way of a non-limiting example, the input device may be a keyboard, which has general purpose keys, special purpose keys or some combination of general and special purpose keys. The input device may comprise a physical device, e.g., a real or physical keyboard. The input device may comprise a virtual device provided using one or more components, e.g., software and/or hardware components, configured to display the input device, such as a keyboard, and receive input, e.g., button input. By way of some non-limiting examples, the virtual device might be a virtual keyboard displayed using a touchscreen under the control of a software component, such that actuation of an area of the touchscreen associated with a key may be translated into a signal indicating the key's selection by the user.

In accordance with one or more embodiments, an automated handshaking is performed prior to use of an input device, e.g., a keyboard, with an online casino-style game, or games, and/or a website providing one or more online casino-style games. In accordance with one such embodiment, authorization information, or information for use in authorizing the input device for use, is transmitted to at least one server, e.g., a server connected with the website providing access to one or more online casino-style games. The authorization information is used to determine whether or not to authorize use of the input device. If a determination is made to authorize the input device's use, a response is transmitted by the at least one server to permit use of the input device. If a determination is made to not authorize use of the input device, a response is transmitted indicating the denial. A denial response may provide information to notify a user of actions that may be taken in connection with another attempt to gain authorization.

In accordance with one or more embodiments, some or all of an input device may be inoperable without authorization. In accordance with one or more such embodiments, the input device may be inoperable for any type of use, including use with any online gaming site and/or any online casino-style video game. Additionally, the input device may be operable for a certain one or more online gaming site(s) and or a certain one or more online game(s), and rendered inoperable for any use, e.g., another gaming site, another online game, etc. The input device may be operable for certain permitted use(s) and inoperable for any use other than the permitted use(s), e.g., any unauthorized use and/or user(s). In so doing, the input device's use may be limited and controlled.

By way of a non-limiting example, an input device may be provided to a user that signed up with an online gaming site. When the user accesses the online gaming site, information may be exchanged between at least one server and the input device. Such information may include information identifying the device, the user and the access being requested. The at least one server may use received information to determine whether or not to allow use of the input device in connection with the requested access. If use of the input device is authorized, information may be exchanged with the input device to make it operational for use with a given site, e.g., an online gaming site, and/or one or more online games, e.g., one or more games made available via a given site. If use of the input device is not authorized, information may be exchanged with the input device to make it inoperable for use. A lack of information exchange may result in the input device being rendered inoperable.

In accordance with one or more embodiments, the input device may comprise casino-style video game controls alone or in combination with general purpose controls. By way of a non-limiting example, the input device may be an input device, e.g. a keyboard, comprising game functional keys, e.g. bet, hold, deal, spin, cash out, etc. keys, alone or in addition to other keys, e.g., general purpose keys, such as alphanumeric keys, navigational/cursor keys, etc. In accordance with one such embodiment, a portion of the input device, e.g., the general purpose controls of the input device, may be operational at least during authorization to facilitate authorization. By way of a non-limiting example, and input device's general purpose controls may be operational to allow the user to submit an authorization request and/or to provide information requested during authorization, e.g., username and password. In accordance with one or more embodiments, different portions of the input device can be operable while other portions are inoperable.

In accordance with one or more embodiments, the at least one server used in connection with an input device's authorization may use information stored in a database, or other data store. By way of a non-limiting example, such stored information may comprise device information, user information, authorized use(s) for the input device, etc. The at least one server may use information received, e.g. information about the input device, the user, access requested, etc., in combination with information stored in the database to determine whether or not to authorize use of the input device. The database may store status information about the device, such as whether or not authorization has been granted to use the device, the user for whom authorization has been granted, the particular use(s), e.g., game(s) and/or site(s), authorized, the portion(s) of the input device for which operation is authorized or unauthorized, etc. The database may store a timestamp, e.g. time of day, date, etc., identifying the timing of the authorization, which may be used to determine an expiration time frame for an authorization. By way of a non-limiting example, the timestamp may be used to determine the length of time since the last authorization, and if the length of time exceeds a certain threshold time a new authorization might be initiated.

In accordance with one or more embodiments, one input device may be used by multiple users. In such a case each user may be required to seek authorization to use the device. Alternatively, the device may be authorized once for use by any of the multiple users.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise a system and method of authorizing an input device for playing an online casino-style video game and/or accessing a website providing an online casino-style video game. In a preferred embodiment, input device authorization may be implemented using a client-side portion and a server-side portion. The client-side portion may be implemented by the input device, a computing device coupled to the input device or some combination thereof. The server-side portion may be implemented by at least one server computer. In accordance with one or more embodiments, input device authorization may be performed solely on the client side or the server side.

In the following description, a keyboard is used as an example of an input device that may be authorized in accordance with one or more embodiments of the present disclosure; however, it should be apparent that any type of input device may be used in connection with embodiments of the present disclosure. For simplicity sake and unless otherwise indicated and while the following description may refer to a single video game and/or a single website, it should be apparent that it is not limited to one but may be more than one video game and/or web site.

In accordance with one or more embodiments, an input device, such as a keyboard, may be a standard device having standard features and layout, may be a unique device having unique features and/or layout, or some combination thereof. By way of some non-limiting examples of unique features, the input device may comprise some or all of start, betting, change, cash out, hold, cancel, deal, draw, spin, etc. buttons and/or controls. By way of some non-limiting examples, a unique layout may comprise standard features and/or unique features in a unique layout. A unique layout and or unique features may be particularly suited for an online casino-style video game, or games offered by an operator, or game provider. One example of a keyboard that may be used as an input device is described in U.S. Pat. No. 8,488,069, the contents of which are incorporated herein by reference.

Figure 1:
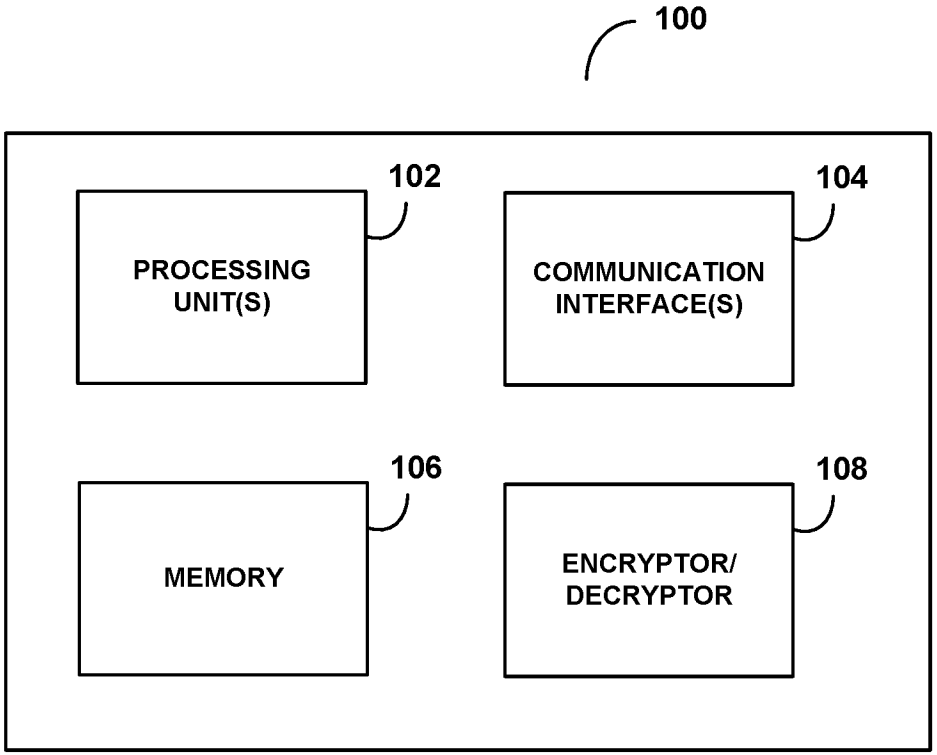
FIG. 1 illustrates a device that may be authorized for one or more online casino-style video game(s) and/or one or more online gaming site(s).

FIG. 1 illustrates components of a device having one or more physical keys, virtual keys or some combination thereof, which may be authorized for use with an online casino-style video game(s) and/or an online gaming site in accordance with one or more embodiments. Device 100 comprises one or more processing units 102, one or more communication interface(s) 104 and memory 106. Device 100 may comprise and/or be coupled to one or more displays (not shown). Device 100 may further optionally comprise an encryption/decryption module 108, which may be used to encrypt and decrypt information, e.g. information stored in memory 106, such as and without limitation information exchanged with a server, e.g., transmitted to and/or received from the server, during authorization, etc. Processing unit(s) 102 may include control circuitry to convert key activations, e.g., key presses, selections, etc., to key codes, touch screen coordinates, etc., which may be forwarded to another device, e.g. a computing device communicatively connected with device 100 via communication interface 104. Module 108 may comprise hardware, software or some combination thereof, and may implement any encryption mechanism now known or later developed.

In accordance with one or more embodiments, device 100 may be any computing device including without limitation a smart input device, a smart keyboard, smartphone, personal digital assistant (PDA), tablet, handheld computer, desktop computer, laptop computer, etc. In accordance with one or more embodiments, device 100 may comprise or be coupled to one or more input devices, such as and without limitation an electronic display screen, such as and without limitation the electronic display screen described in U.S. Pat. No. 8,488,069, an electronic visual touchscreen display, virtual keyboard, physical keyboard, or some combination thereof.

In accordance with one or more embodiments, processing unit(s) 102 may be configured to inhibit processing of any input, e.g., inhibit conversion of a key press to a key code and/or transmission of a key code to another device, in a case that such input has not been authorized. Alternatively and in accordance with one or more embodiments, processing unit(s) 102 may be configured to process certain input, such as and without limitation used for authorization, while inhibiting other input, such as and without limitation input used for online casino-style game play, prior to authorization. By way of a non-limiting example, processing unit(s) 102 may process input, e.g., input from certain keys, for obtaining for authorization, e.g., alphanumeric, navigation/cursor, enter, delete, shift, etc. keys, and not process, or otherwise prohibit, other input, e.g., input from certain keys, associated with the game play and/or website access until authorization of such game/site input is granted. Alternatively, input might be processed by the processing unit(s) 102, transmitted to another computing device, which filters out unauthorized input.

Device 100 and its processing unit(s) 102 may be configured to implement some or all handshaking performed in authorizing input. In accordance with one or more embodiments, the processing unit(s) 102 may use the communication interface(s) 104 to communicate authorization information. By way of some non-limiting examples, the communication interface(s) 104 may comprise wireless and/or wireless communication interfaces. By way of some further non-limiting examples, a wired interface may be any wired interface now known or later developed, including a universal serial bus (USB), serial interface, parallel interface, PS/2 interface, ethernet, etc. A wireless interface may be any wireless interface now known or later developed, including a Bluetooth interface, radio frequency interface, infrared interface, any of the wireless networking protocols under the IEEE 802.11 protocol set, etc.

By way of a non-limiting example, the processing unit(s) 102 may be configured to communicate information stored in memory 106, information received from the user, etc. to an authorization service. The processing unit(s) 102 may be further configured to receive a response from the authorization service indicating whether or not use is authorized, which response may identify the activities for which input is authorized, and to use such authorization information in processing input received from a user/player via the device 100.

Received information may be stored in memory 106. The received information may be encrypted by component 108 prior to being stored. In accordance with one or more embodiments, memory 106 may store information used in authorization, e.g., information identifying some or all of the device 100, such as and without limitation a device identifier, authorization status, authorization timestamp, specific game(s)/site(s) authorized, authorized user(s), etc. Of course, it should be apparent that the memory 106 may store additional and/or different information. Some or all of the stored information may be encrypted, and component 108 may be used to decrypt encrypted information retrieved from memory 106.

In the example shown in FIG. 1, the communication interface(s) 104 may serve to communicatively couple the device 100 to any computing device, including and without limitation a PDA, cellular phone, tablet, handheld computing device, laptop, desktop computer, set-top device, smart TV, server computer, etc.

Figure 2:
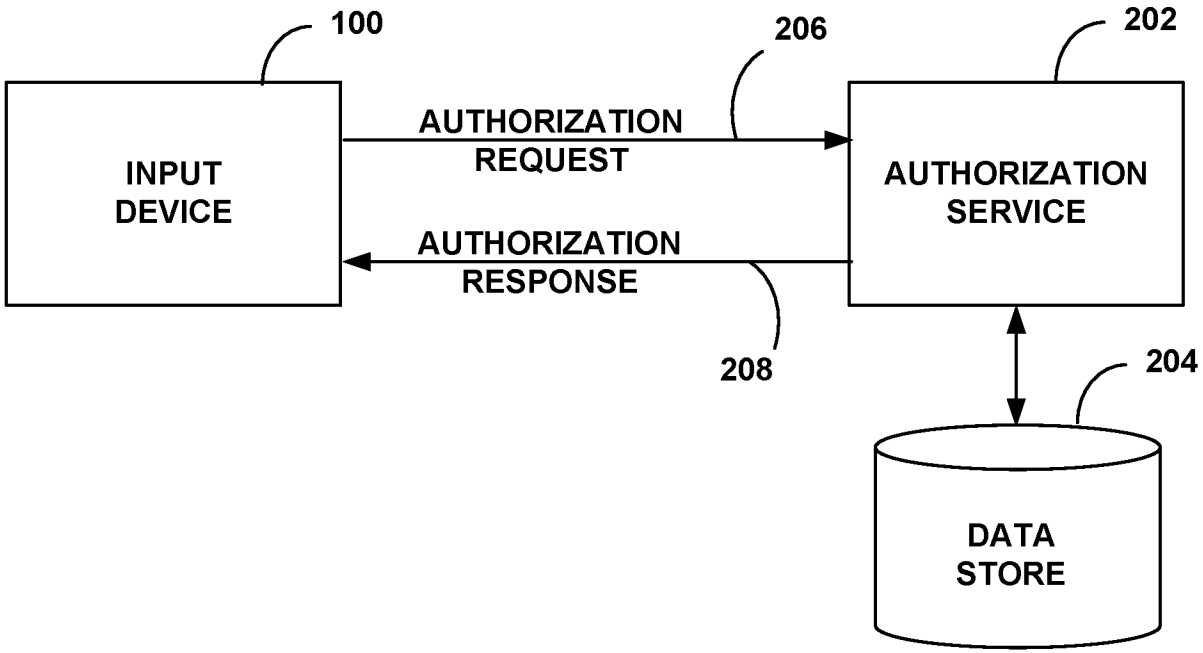
FIG. 2 diagrammatically illustrates an example of handshaking that may be used in authorizing an input device.

FIG. 2 diagrammatically illustrates an example of handshaking that may be used in authorizing an input device. In the example shown in FIG. 2, the device 100 transmits authorization information via one or more transmissions 206 for use by at least one other device in connection with an authorization request. In accordance with one or more embodiments, the at least one other device may be a remote device, such as and without limitation a server computing device, or server computer, associated with an online casino-style game and/or an online casino-style gaming website. The server(s) 202 may use the information received via the transmission(s) 206 to determine whether to authorize use of an input device. The server(s) 202 may access information stored in a data store, e.g. data store or database 204, which may comprise one or more data stores, to validate the information received via the transmission(s) 206 and determine whether to grant or deny authorization of some or all of the input via device 100. In a case that the server(s) 202 makes a determination to grant authorization, information stored in the database(s) 204 may be used to identify the game(s) and/or site(s) that input via device 100 is authorized. A response may be communicated as part of the handshaking via transmission(s) 208. The transmission(s) 206 and transmission(s) 208 may use any communication pathway, wired and/or wireless, including without limitation any network, e.g. a local area network, a wide-area network, the Internet, etc.

Figure 3:
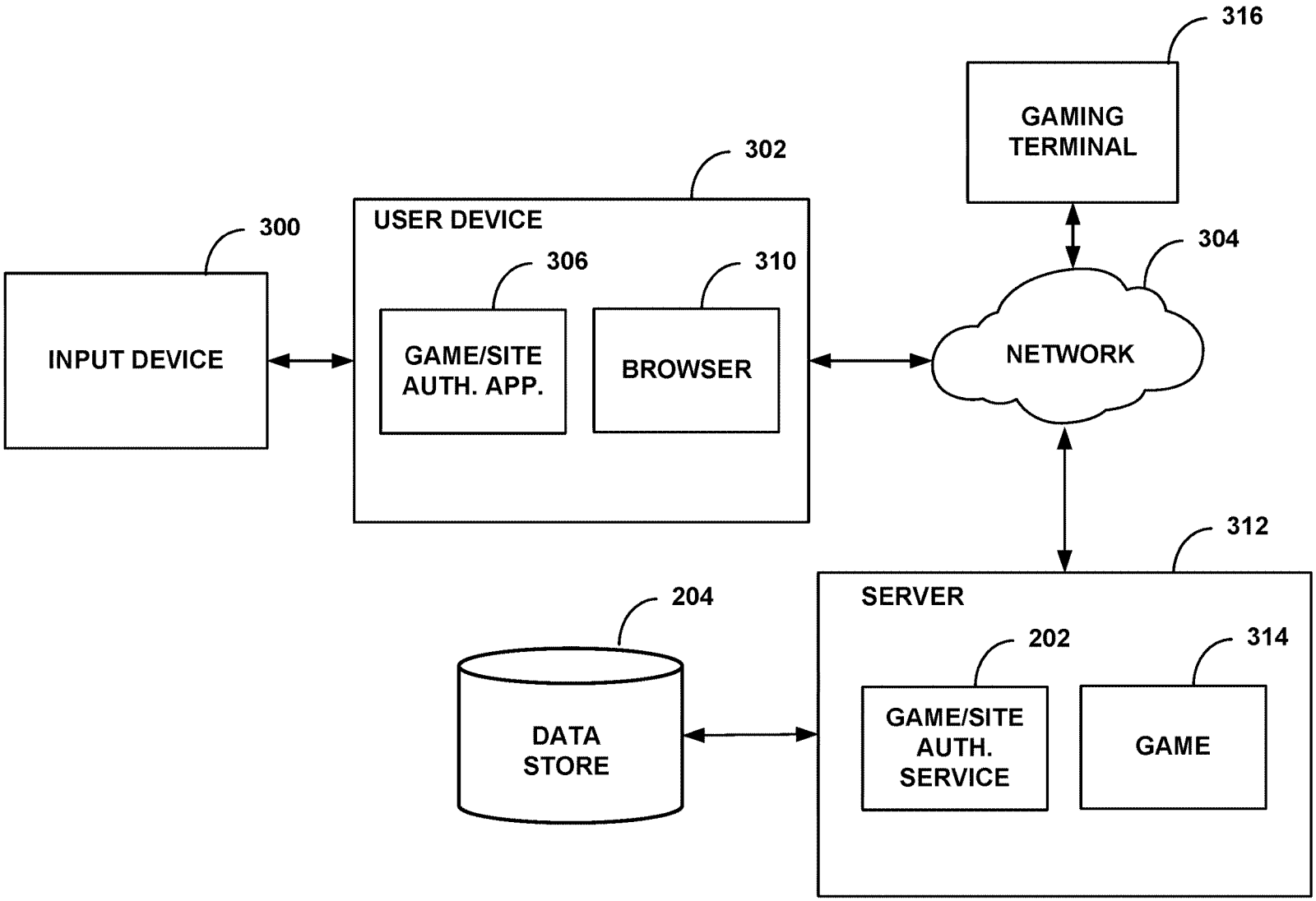
FIG. 3 diagrammatically illustrates another example of handshaking that may be used in authorizing an input device.

In accordance with one or more embodiments, handshaking may be performed via one or more user computing devices, such as is shown in the example of FIG. 3, which provides another example of handshaking that may be used in authorizing input device 300.

In the example shown in FIG. 3, the input device 300 comprising one or more keys, such as and without limitation one or more physical keys, virtual keys, etc., is communicatively coupled to a user device 302, which is communicatively coupled to one or more remote devices, such as and without limitation the server computer 312 via a network 304, e.g., the internet and/or another network. The input device 300 may be coupled to computing device 302 via a wired and/or a wireless connection. As shown in the example, the computing device 302 may include an authorization application 306, which may be in communication with authorization service 202 of server 312. Component 306 may be referred to as client-side authorization component and may be used in the authorization of the input device 300. Similarly, the server computer(s) 312 includes the authorization service 202, which may be referred to as the server-side authorization component. Server 312 may provide the online casino-style game 314 and/or an online casino-style gaming website (not shown).

In the example shown in FIG. 3, the device 300 is shown as being separate from the device 302; however, it should be apparent that input device 300 may be an integral component of the device 302. By way of one non-limiting example, user device 302 may be a mobile electronic device, such as a smartphone or table, and the input device 300 may be a touch-sensitive display screen of the mobile electronic device. Furthermore and while the example of FIG. 3 shows the client-side component 306 as being resident on the user device 302, the component 306 may be a component of, e.g., reside on, the input device 300. The input device 300, either alone or in combination with the user device 302, may correspond to the device 100 of FIG. 1.

In accordance with one or more embodiments, user device 302 may be any type of computing device, including without limitation a desktop computer, laptop computer, mobile electronic device, set-top box, media player, smart television, etc.

By way of a non-limiting example, the computing device 302 may execute a browser application, and the authorization application 306 on the computing device 302 may comprise a browser application plug-in, JavaScript code, etc. By way of some non-limiting examples, application 306 may be downloaded via the Internet 304, uploaded from a storage device, e.g. a CD-ROM, provided with the device 300. By way of some further non-limiting examples, application 306 may be downloaded in connection with a web page served to the computing device 302, e.g., a webpage served by an online casino-style video gaming site.

By way of a non-limiting example, a user/player might register with an online casino-style gaming site provided by one or more server computing devices, such as server 312, of a game/site vendor or other entity. In a case that input device 300 is a physical device, the device might be sent to a registered user, such as by a game/site vendor or other entity. Alternatively, a user might purchase, or otherwise obtain, input device 300 from the game/site vendor or other entity prior to or after registration. In a case that the input device 300 is a virtual input device, software may be downloaded to one or both of the input device 300 and the computing device 302, such as in connection with the user's registration. By way of a non-limiting example, the software may be downloaded by server 312. Preferably, input device authorization may be performed after the user is in possession of the input device 300 and/or user device 302.

In the example shown in FIG. 3, server 312, which may be a game/site vendor's server, may include a game/site authorization service, such as the authorization service component 202 of FIG. 2, to be used for authorizing the input device 300 for use with the game/site, either alone or in combination with the game/site authorization application 306 of the user device 302.

In accordance with one or more embodiments, the input device 300 and/or user device 302 may be communicatively and/or logically coupled to gaming terminal 316, which may correspond to the gaming terminal described in U.S. application Ser. No. 13/865,500. By way of a non-limiting example, upon authorization for use with the gaming terminal, input device 300 may communicate directly and/or via user device 302 to provide input to the gaming terminal to enable a user of input device 300 to play a game provided by the gaming terminal.

In accordance with one or more such embodiments, the input device 300 and/or user device 302 may be communicatively and/or logically coupled to a gaming system, casino system, vendor game server, etc. described in U.S. application Ser. No. 13/865,500.

Once authorized in accordance with one or more embodiments, the input device 300 and/or the user device 302 may be programmed to send inputs to manipulate any game 314 available via server 312. By way of some non-limiting example, once the input device 300 is authorized, at least some portion, such as one or more keys, of the input device 300, may be enabled for use by the user such that the user's input via such portion(s) of the input device 300 is used with the authorized game(s)/site(s). Alternatively or additionally, one or more buttons and/or keys may be displayed on an input device, e.g., a touchscreen input device, upon authorization. The enabled portion(s) of the input device 300, e.g., and/or the one or more buttons, keys, etc., may be particular to the game 314 being played on the server 312. By way of some non-limiting examples, the buttons/keys may be HOLD, DRAW, MAX BET, etc. for a video poker game, SPIN, MAX BET, etc. for a slot-type game, etc.

Figure 4A:
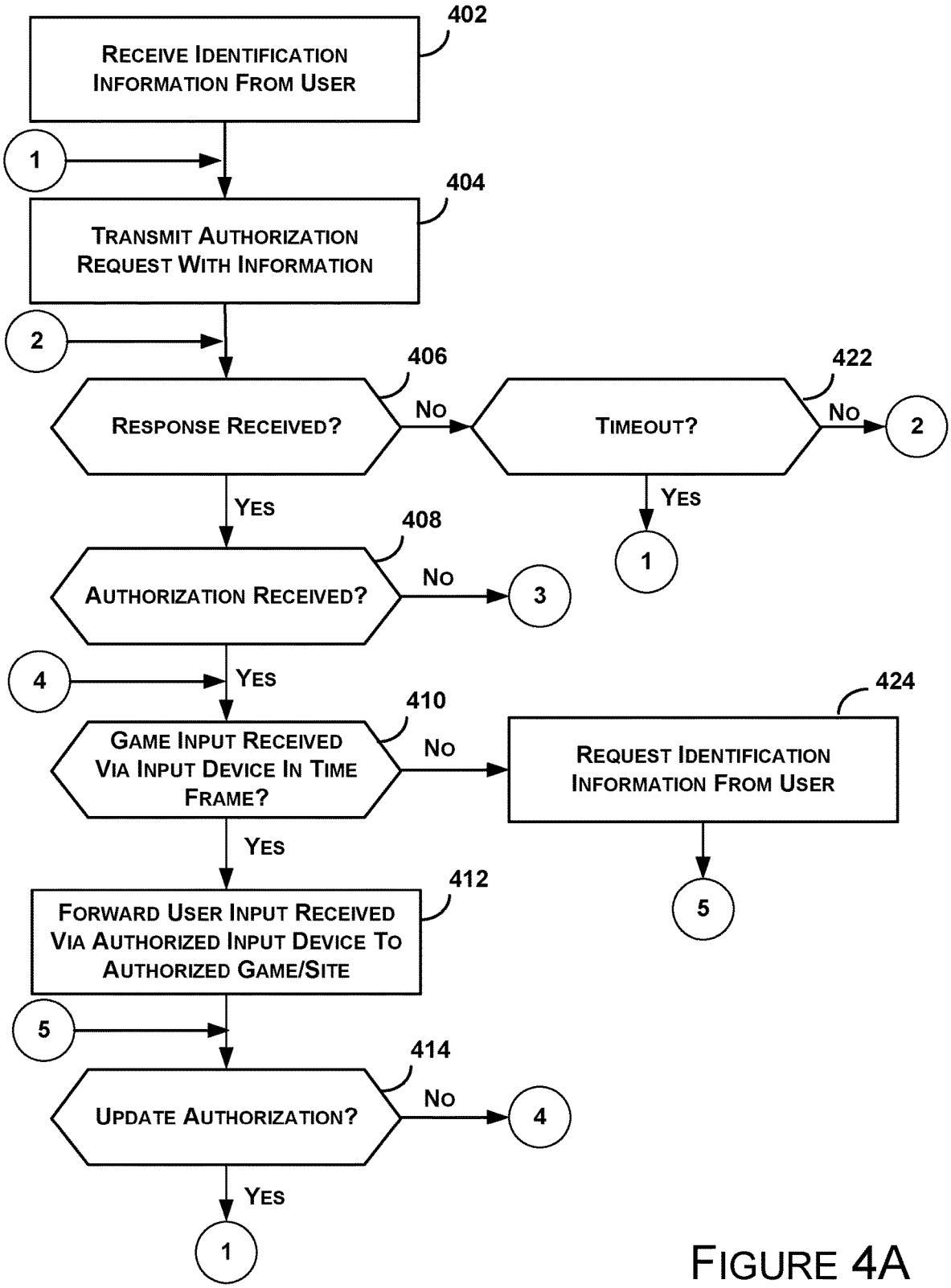
FIG. 4, which comprises FIGS. 4A and 4B, diagrammatically illustrates a client-side authorization process flow.
Figure 4B:
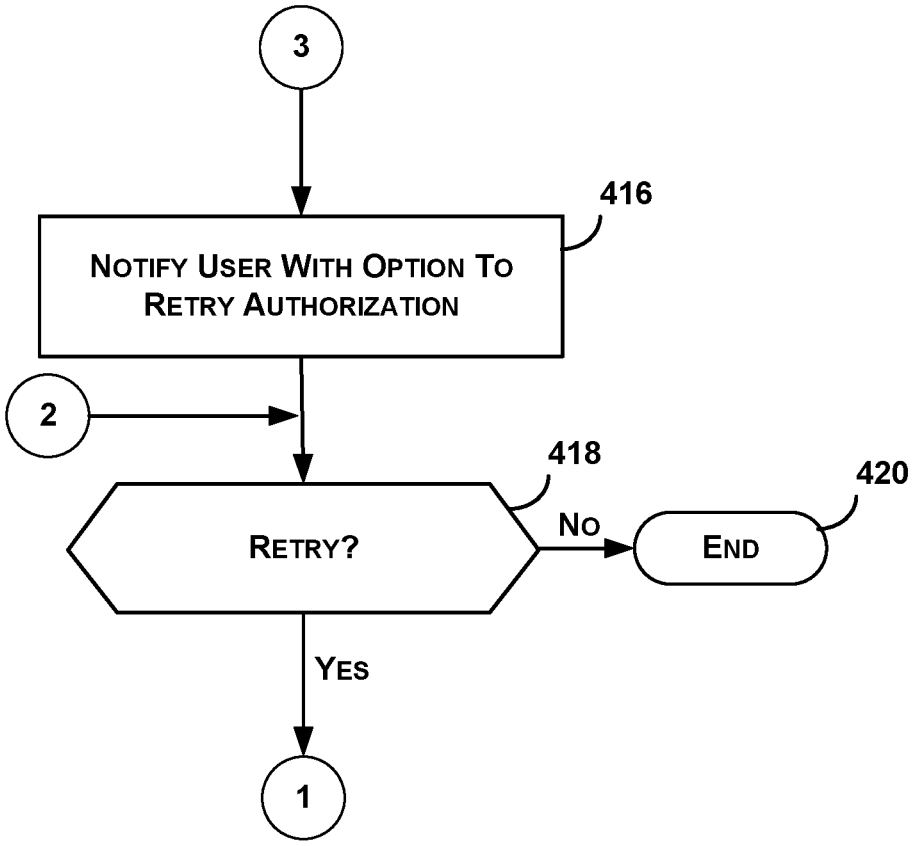

FIG. 4, which comprises FIGS. 4A and 4B, diagrammatically illustrates a client-side authorization process flow. In accordance with one or more embodiments, the client-side authorization process flow is performed in connection with a server-side process, such as and without limitation the server-side process flow described below in connection with FIG. 5. While FIGS. 4 and 5 may be discussed with reference to input device 300, it should be apparent that the functionality described in connection with FIGS. 4 and 5 may be used in connection another input device, including without limitation device 100.

FIG. 4 may be used for a new authorization, e.g., a first-time authorization, of an input device, such as and without limitation input device 300, or it may be used to reauthorize a previously-authorized input device 300. In the latter case, the process flow illustrated in FIG. 4 might be used for a new session, e.g. when a player logs into a gaming web site, after a certain time has elapsed since authorization, etc. The process flow illustrated in FIG. 4 may be implemented by the input device 300, the user computing device 302, or some combination thereof.

With reference to FIG. 4A, at step 402, identification information is received from the user. By way of a non-limiting example, the identification information may be received via input device 300 and/or another input device. At step 404, an authorization request is transmitted with information for use in authorizing input device 300. The authorization request and information might be sent via one or more networks, which one or more networks may include the internet. By way of a non-limiting example, authorization information may include one or more of device identification information identifying the input device, e.g., one or more of a unique device identifier, software and/or hardware version identifier(s), device manufacturer's identifier, model number, etc., user identification information, e.g., a unique user identifier, such as and without limitation a user identifier and password, and information identifying the requested access, e.g., information uniquely identifying the game(s) and/or site(s) for which the input device 300 is to be used. By way of a non-limiting example, the information uniquely identifying a game and/or a site might be in the form of a universal resource locator (URL). In accordance with one or more embodiments, the game/site identification information may be any identification information for use in accessing a networked game/site and/or one or more networked computing devices providing the game/site.

Processing continues at step 406 to wait for a response to the authorization request. As shown in the example of FIG. 4, the time for awaiting a response may be monitored to ensure that the wait time does not exceed a certain time.

More particularly, if it is determined, at step 406, that no response is received, processing continues at step 422 to determine whether a period of time has expired. If so processing continues at step 404 to retransmit the authorization request. In addition, or alternatively, the user might be notified of the delay in the response, and may be given one or more options for proceeding, e.g., retransmitting the request, attempting the authorization at a later time, etc. If a determination is made, at step 422, that the time for awaiting a response has not yet expired, processing continues at step 406 to await the response.

If a determination is made, at step 406, that a response is received, processing continues at step 408 to determine whether the response indicates that the input device 300 is authorized for use with one or more games and/or sites.

If the received response does not indicate that the input device 300 is authorized for use with one or more games/sites, processing continues at step 416 of FIG. 4B. At step 416 of FIG. 4B, the user may be notified of the unsuccessful authorization attempt and given an opportunity to make another authorization request. The notification may identify a reason for the unsuccessful authorization, such as and without limitation invalid user identification information, invalid input device information, unauthorized request for game(s) and/or site(s), game(s) and/or site(s) available for authorization, etc. Such information may assist the user in determining whether to make another authorization request and/or the information to provide with another authorization request.

If a determination is made, at step 408, that the received response indicates that the input device 300 is authorized for use with one or more games and/or sites, processing continues at step 410. In accordance with one or more embodiments, the received response may include a URL to which some or all of the input received via the input device 300 may be forwarded. By way of a non-limiting example, the input received via the input device 300 may be game input that is to be forwarded to an online casino-style game using a URL, or other resource locator, provided in the response received at step 406. In accordance with one or more embodiments, the user may be provided with an indication that the input device is available for use with the online casino-style game(s) and/or the online casino-style gaming websites(s). By way of some non-limiting examples, such an indication can be an audible indication, such as a sound, or sounds, a visible indication, such as a displayed message, highlighted keys, etc. a tactile indication, such as a vibration, or some combination thereof.

At step 410, a determination is made whether input is received from the user via input device 300 within a given time frame. By way of a non-limiting example, a timeframe may be set to limit or control the temporal extent of the authorization. The time frame may be provided in the information received in response to the authorization request, may be a default setting, etc. In a case that a temporal extent is not used, the timeframe may be a null value, or another value indicating an unlimited timeframe.

Thus and in accordance with at least one embodiment, at step 410, a determination is made whether user input is received and whether the user input is received within a given time frame. If so, processing continues at step 412 to forward the received input to the authorized game and/or site. In accordance with one or more embodiments, the received input may be forwarded to a URL provided with the information received in response to the authorization request. The authorized destination may be stored in memory 106 and/or storage, e.g., permanent or transitory memory, of computing device 302, for example. By way of a further non-limiting example and with reference to FIG. 3, the input device 300 may forward the received input to browser 310 and/or application 306, which may forward the received input to at least one server 308, e.g., using a received URL, for use by the authorized game and/or site. The authorized destination may be one or more computing devices, e.g., one or more server computers, executing an authorized game and/or web site, for example.

If it is determined, at step 410, that no user input is received within a certain timeframe, processing may continue at step 424 to re-authorize the input device 300. A notification may be sent to the game/site indicating that input device re-authorization is underway, and such information may be used by the game/site to inhibit access to the game/site using the input device 300 until the input device 300 is successfully re-authorized.

If it is determined, at step 410, that user input was received within a certain timeframe, processing continues to step 412 and step 414. At step 412, the user input is forwarded to the authorized game/site. At step 414, a determination is made whether or not to renew, or update, the authorization. In accordance with one or more embodiments, as discussed above, an authorization may be given for a certain amount of time, and if the time is expired an attempt is made to renew the authorization. If so, processing may continue at step 404 to request an updated or new authorization using the user identification information provided with the original authorization request. Alternatively, processing may continue at step 402 to request user identification information from the user, which may be transmitted with the request at step 404. In accordance with one or more embodiments, a reauthorization may be initiated by the server, e.g., server 312. If it is determined, at step 414, not to request an updated/new authorization, e.g., the previously-granted authorization is not temporally limited or the time limit has not yet been exceeded, processing continues at step 410 to await further input from the user via device 300. In accordance with one or more embodiments, the time frame used in step 410 and the temporal limit used in step 414 may be alike or different.

Referring again to step 408 of FIG. 4A, if a determination is made that a received response does not indicate that authorization for using device 100 is granted, processing continues at step 416 of FIG. 4B. The user may be notified that use of device 300 is not authorized and given options for proceeding. By way of some non-limiting examples, the user may be given an option to select from one or more games and/or sites, e.g., game(s)/site(s) that the user would be authorized upon request, has previously been authorized, currently has authorization etc. If the user is not a valid user, e.g., user identification information not recognized and/or the user has yet completed registration, etc., the user may be given an option to register before re-submitting an authorization request. In other words, the user may be given various options, which may be determined based on the reason(s) for denying the device authorization. At step 418, a determination is made whether to submit another authorization request. If so, processing continues at step 402 to transmit an authorization request. If not, processing may end at step 420.

Figure 5:
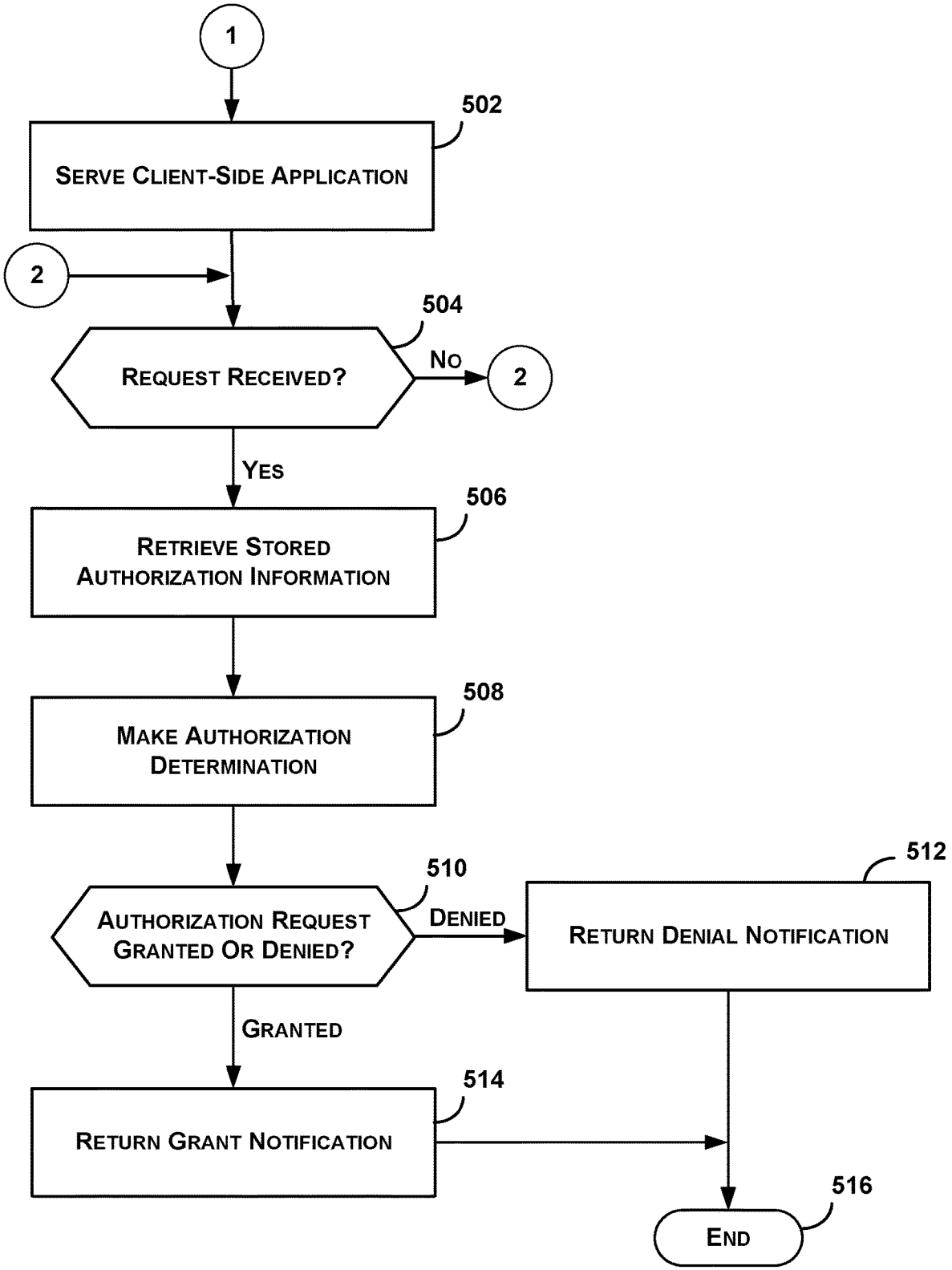
FIG. 5 diagrammatically illustrates a server-side process flow.

FIG. 4 illustrates an example of a client-side process flow. FIG. 5 illustrates an example of a server-side process flow, which may be used in correspondence with a client-side process, such as that illustrated in the example of FIG. 4. A server-side process flow such as that shown in FIG. 5 may be implemented by one or more computing devices, e.g., one or more server computers, which may include server computer 312, which computing device(s) may implement one or more games and/or sites for which authorization of the input device 300 is sought.

The illustrated process flow of FIG. 5 may process an authorization renewal or a new authorization, for example. The process may be performed in connection with an authorization request received from a client-side application. The client-side application may be transmitted in step 502. By way of a non-limiting example, the client-side application might be sent in connection with a web page, e.g., a page of an online gaming web site. By way of a further non-limiting example, the web page, which may be written in a markup language such as Hypertext Markup Language (HTML), may include a reference to the client-side application, which reference results in the client-side application being served in connection with serving the web page. The web page may be served in response to a user navigating to the web page using a browser executing on the user's computing device, e.g., computing device 302. As yet another non-limiting example, the client-side application might be served as part of installation of input device 300, e.g., installation of device 300 on computing device 302. The client-side application might be retrieved from any storage location, including a storage location coupled to input device 300, such as from memory of computing device 302. In a case that input device 300 has internal memory, the client-side application might be retrieved from the memory of the input device 300. The client-side application may be retrieved from the memory of the input device 300, from the memory of computing device 302, or some combination of both.

In the process flow shown in FIG. 5, processing awaits an authorization request, e.g., an authorization request transmitted by a client-side application, at step 504. If a determination is made, at step 504, that a request is not received, processing continues at step 504 to await a request. If it is determined, at step 504, that an authorization request is received, processing continues at steps 506 and 508 to process the received request. By way of a non-limiting example, information received in the request may be used to retrieve authorization information, at step 506, which information may be used to make a determination, at step 508, whether to grant or deny the authorization request. By way of some further non-limiting examples, the received request may include information identifying the input device, the game(s)/site(s) for which authorization to use the input device is being requested, information identifying the user the requesting user, etc.

In accordance with one or more embodiments, the information retrieved at step 506 may be retrieved from a data store, such as database 204. Such a data store may include an input device record including a unique device identifier and information about the input device. The data store may further include information associating the input device with each game and/or site that the device may be authorized for use. By way of some non-limiting examples, the data store may map an input device's unique identifier to each game and/or site for which the device may be used, and/or each game and/or site that the device is not authorized to be use. The data store may further include information associating the input device with each user that is authorized to use the input device, e.g., the data store may include a mapping, or association, between the device's unique identifier and the user's unique identifier. A mapping may also exist between a user's unique identifier and the identifier of each game and/or site that the user may be authorized to use the device. The mapping may be used to identify the game(s) and/or site(s) that available, upon authorization, for each user and/or input device.

Thus, one or more inquiries may be made, at step 508, in determining whether or not to grant the requested authorization. By way of a non-limiting example, a determination may be made whether or not the user identified in the authorization request is authorized to use the input device identified in the authorization request, a determination may be made whether or not the identified user is authorized to access the game(s)/site(s) identified in the authorization request, a determination may be made whether or not the identified device is authorized for use with the game(s)/site (s) identified in the authorization request, a determination may be made whether or not the identified user is authorized to use the identified device with the identified game(s)/site (s), etc.

As yet further illustration and without limitation, a determination may be made whether the user identifier associated with the request, e.g., received with the request, matches a stored user identifier. If so, a determination may be made whether there is a stored mapping, or association, between the user identifier and the device identifier associated with the request. If so, a determination may be made whether there is a stored mapping, or association, between the device identifier and at least one game/site identifier associated with the request. If so, the request for authorization to use the input device, e.g., input device, with the at least one game/site may be granted. Otherwise, the request is denied.

At step 510, a determination is made whether the authorization request is granted or denied at step 508. If denied, a response indicating the denial may be provided. If granted, a response indicating the grant may be provided. In either case, processing of the current request may end at step 516.

Figure 6:
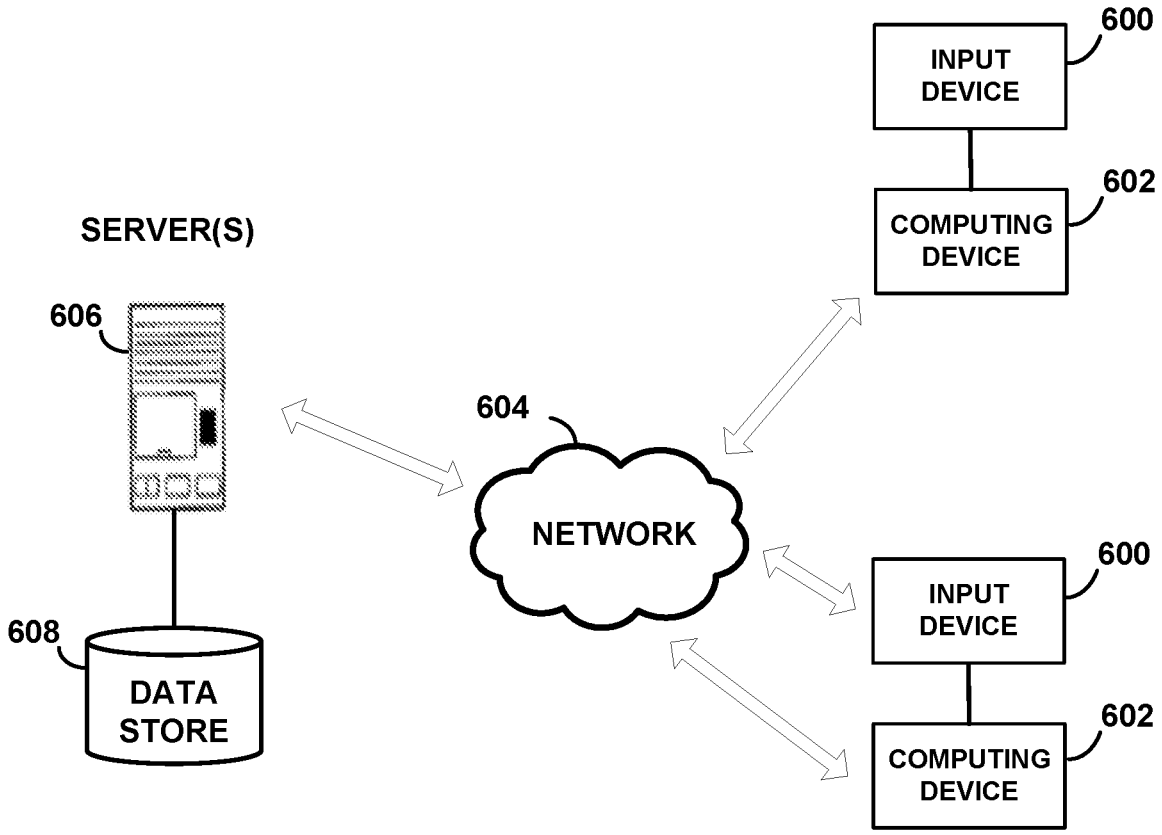
FIG. 6 illustrates some components that can be used in connection with one or more embodiments of the present disclosure.

FIG. 6 diagrammatically illustrates a system and components thereof that may be used in connection with one or more embodiments. In the example shown, the computing device 602, which may correspond to the user computing device 302, may be coupled to an input device 600, which may correspond to input device 300. Input device 600 and computing device 602 may be a single component and may correspond to device 100, for example. One or both of computing device 602 and input device 600 may be communicatively coupled to at least one server 606 via network 604. The server(s) 606 may correspond to the server(s) 312, for example. Network 604 may comprise a local area network, a wide area network, the Internet, etc. Data store 608 may be local to a server 606 and may be accessible by server 606. Data store 608 may correspond to data store 204.

Figure 7:
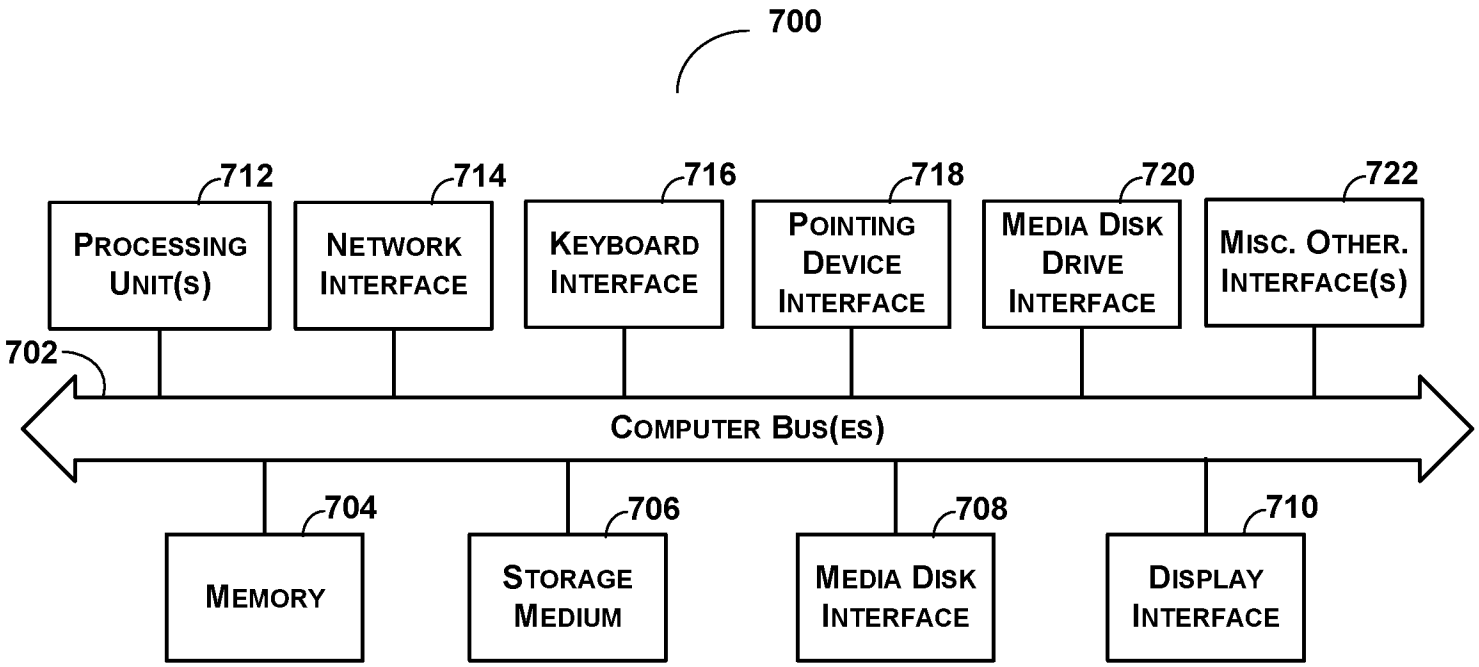
FIG. 7 is a detailed block diagram illustrating an internal architecture of a computing device in accordance with one or more embodiments of the present disclosure.

FIG. 7 is a detailed block diagram illustrating an internal architecture of a computing device, e.g. the user computing device 302, server computer 606 and/or device 100. As shown in FIG. 7, internal architecture 700 includes one or more processing units, processors, or processing cores, (also referred to herein as CPUs) 712, which interface with at least one computer bus 702. Also interfacing with computer bus 702 are computer readable medium, or media, 706, network interface 714, memory 704, e.g., random access memory (RAM), run-time transient memory, read only memory (ROM), etc., media disk drive interface 720 as an interface for a drive that can read and/or write to media including removable media such as floppy, CD ROM, DVD, etc. media, display interface 710 as interface for a monitor or other display device, keyboard interface 716 as interface for a keyboard, pointing device interface 718 as an interface for a mouse or other pointing device, and miscellaneous other interfaces not shown individually, such as parallel and serial port interfaces, a universal serial bus (USB) interface, and the like.

Memory 704 interfaces with computer bus 702 so as to provide information stored in memory 704 to CPU 712 during execution of software programs such as an operating system, application programs, device drivers, and software modules that comprise program code, and/or computer executable process steps, incorporating functionality described herein, e.g., one or more of process flows described herein. CPU 712 first loads computer executable process steps from storage, e.g., memory 704, computer readable storage medium/media 706, removable media drive, and/or other storage device. CPU 712 can then execute the stored process steps in order to execute the loaded computer-executable process steps. Stored data, e.g., data stored by a storage device, can be accessed by CPU 712 during the execution of computer-executable process steps.

Persistent storage, e.g., medium/media 706, can be used to store an operating system and one or more application programs. Persistent storage can also be used to store device drivers, such as one or more of a digital camera driver, monitor driver, printer driver, scanner driver, or other device drivers, web pages, content files, playlists and other files. Persistent storage can further include program modules and data files used to implement one or more embodiments of the present disclosure, e.g., listing selection module(s), targeting information collection module(s), and listing notification module(s), the functionality and use of which in the implementation of the present disclosure are discussed in detail herein. Persistent storage 706 may comprise memory store 106, data store 204 and/or 608.

For the purposes of this disclosure a computer readable medium stores computer data, which data can include computer program code that is executable by a computer, in machine readable form. By way of example, and not limitation, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

Those skilled in the art will recognize that the methods and systems of the present disclosure may be implemented in many manners and as such are not to be limited by the foregoing exemplary embodiments and examples. In other words, functional elements being performed by single or multiple components, in various combinations of hardware and software or firmware, and individual functions, may be distributed among software applications at either the client or server or both. In this regard, any number of the features of the different embodiments described herein may be combined into single or multiple embodiments, and alternate embodiments having fewer than, or more than, all of the features described herein are possible. Functionality may also be, in whole or in part, distributed among multiple components, in manners now known or to become known. Thus, myriad software/hardware/firmware combinations are possible in achieving the functions, features, interfaces and preferences described herein. Moreover, the scope of the present disclosure covers conventionally known manners for carrying out the described features and functions and interfaces, as well as those variations and modifications that may be made to the hardware or software or firmware components described herein as would be understood by those skilled in the art now and hereafter.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A keyboard for use with an online casino-style game accessed via a website, the keyboard comprising:

a processor and a storage medium for tangibly storing thereon program logic for execution by the processor, the stored program logic comprising:

logic executed by the processor for prohibiting use of at least a portion of the keyboard without authorization of the use of the at least a portion;

transmitting logic executed by the processor for transmitting a request for authorization to use the keyboard with the online casino-style game to a server computer associated with the website, the request comprising user identification information identifying a user, information identifying the online casino-style game, and information identifying the keyboard for validation against a lookup of data from a database of the server computer;

receiving logic executed by the processor for receiving a response to the request, the response comprising an indicator of whether the keyboard is authorized for use by the user to play the online casino-style game;

permitting logic executed by the processor for permitting the user to use the keyboard to play the online casino-style game if the received indicator indicates that such use is authorized, the permitting logic comprising forwarding logic executed by the processor for forwarding the user's input received via the keyboard to the online casino-style game; and a plurality of keys on the keyboard, the keys being casino-style game keys that include at least one of a bet key, a spin key, a max bet key, a hold key, a draw key, and a cash out key.

2. The keyboard of claim 1, wherein at least some of casino-style game keys of the keyboard are disabled from use by the user until the received indicator indicates that use of the casino-style game keys is authorized.

3. The keyboard of claim 2, wherein the keyboard further comprises a alphanumeric keys, the alphanumeric keys are enabled until a successful authorization of the casino-style game keys is completed, the alphanumeric keys are disabled after the successful authorization is completed, and the casino-style game keys are disabled before the authorization is successful, and are enabled after the authorization is successful.

4. The device of claim 1, the forwarding logic further comprising:

forwarding logic executed by the processor for transmitting input received from the user via the keyboard to a casino-style game server-side application using a universal resource locator (URL) provided in the response.

5. The device of claim 2, wherein all of the casino-style game keys are disabled until the received indicator indicates that use of the casino-style game keys is authorized.

6. The device of claim 1, wherein the casino-style game keys include the bet key and the cash out key.

7. The device of claim 1, wherein the keyboard is a physical keyboard.

8. The device of claim 1, wherein the keyboard is a virtual keyboard.

9. The device of claim 1, wherein the indicator of whether the keyboard is authorized for use by the user to play the online casino-style game defines which of the plurality of keys on the keyboard are to be authorized for use by the player to play the online casino-style game.

10. A system comprising:

a server computer associated with an online casino-style gaming website; and a keyboard comprising:

a processor and a storage medium for tangibly storing thereon program logic for execution by the processor, the stored program logic comprising:

logic executed by the processor for prohibiting use of at least a portion of the keyboard without authorization of the use of the at least a portion;

transmitting logic executed by the processor for transmitting a request for authorization to use the keyboard with the online casino-style game to the server computer associated with the online casino-style gaming website, the request comprising user identification information identifying a user, information identifying the online casino-style game, and information identifying the keyboard for validation against a lookup of data from a database of the server computer;

receiving logic executed by the processor for receiving a response to the request, the response comprising an indicator of whether the keyboard is authorized for use by the user to play the online casino-style game;

permitting logic executed by the processor for permitting the user to use the keyboard to play the online casino-style game if the received indicator indicates that such use is authorized, the permitting logic comprising forwarding logic executed by the processor for forwarding the user's input received via the keyboard to the online casino-style game; and a plurality of keys on the keyboard, the keys being casino-style game keys that include at least one of a bet key, a spin key, a max bet key, a hold key, a draw key, and a cash out key.

11. The system of claim 10, wherein at least some of the casino-style game keys of the keyboard are disabled from use by the user until the received indicator indicates that use of the casino-style game keys is authorized.

12. The system of claim 11, wherein the keyboard further comprises a alphanumeric keys, the alphanumeric keys are enabled until a successful authorization of the casino-style game keys is completed, the alphanumeric keys are disabled after the successful authorization is completed, and the casino-style game keys are disabled before the authorization is successful, and are enabled after the authorization is successful.

13. The system of claim 10, the forwarding logic further comprising:

forwarding logic executed by the processor for transmitting input received from the user via the keyboard to a casino-style game server-side application using a universal resource locator (URL) provided in the response.

14. The system of claim 11, wherein all of the casino-style game keys are disabled until the received indicator indicates that use of the casino-style game keys is authorized.

15. The system of claim 10, wherein the casino-style game keys include the bet key and the cash out key.

16. The system of claim 10, wherein the keyboard is a physical keyboard.

17. The system of claim 10, wherein the keyboard is a virtual keyboard.

18. The system of claim 10, wherein the indicator of whether the keyboard is authorized for use by the user to play the online casino-style game defines which of the plurality of keys on the keyboard are to be authorized for use by the player to play the online casino-style game.

* * * * *